United States Patent [19]

Perotto

[11] Patent Number: 4,499,675

[45] Date of Patent: Feb. 19, 1985

[54] SKI BOOT INNER SHOE

[75] Inventor: Riccardo Perotto, Volpago, Italy

[73] Assignee: Nordica S.p.A., Montebelluna, Italy

[21] Appl. No.: 458,677

[22] Filed: Jan. 17, 1983

[30] Foreign Application Priority Data

Jan. 22, 1982 [IT] Italy ..... 20612/82[U]

[51] Int. Cl.[3] ..... A43B 5/04

[52] U.S. Cl. ..... 36/119; 36/10

[58] Field of Search ..... 36/10, 71, 117–121, 36/88, 93, 115, 89

[56] References Cited

U.S. PATENT DOCUMENTS 3,407,406 10/1968 Werner et al. ..... 36/119 X
4,154,009 5/1979 Kubelka et al. ..... 36/119
4,428,130 1/1984 Perotto ..... 36/10 X

FOREIGN PATENT DOCUMENTS 2495901 6/1982 France ..... 36/120
626793 12/1981 Switzerland ..... 36/117
1106958 3/1968 United Kingdom ..... 36/119

*Primary Examiner*—James Kee Chi
*Attorney, Agent, or Firm*—Guido Modiano; Albert Josif

[57] ABSTRACT

An inner shoe for ski boots comprising a lower portion enclosing the skier's foot, and an upper portion connected to said lower portion and spanning the front portion of the skier's leg. A peculiar feature of the invention is that it includes a flexible section located between said lower portion and said upper portion to allow mutual flexing of such portions.

6 Claims, 1 Drawing Figure

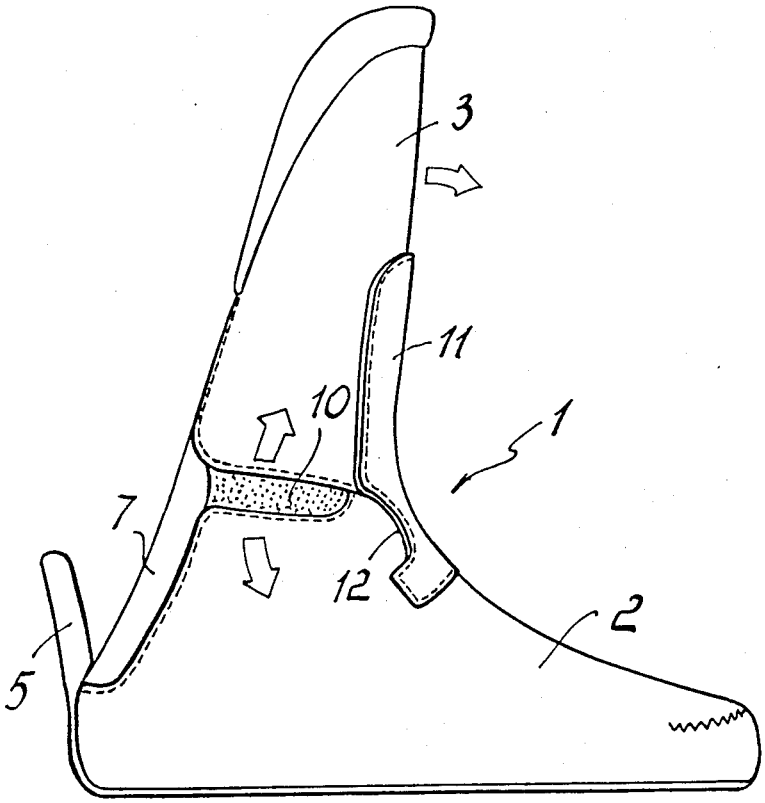
3
11
10
1
7
12
2
5

SKI BOOT INNER SHOE

BACKGROUND OF THE INVENTION

This invention relates to a ski boot inner shoe.

The increasing popularity of ski boots with rear foot entry has led to the need for modifying the configuration of the inner shoes used in ski boots of traditional design in order to facilitate the introduction of the skier's foot into the ski boot.

The solutions adopted heretofore provide such an inner shoe which only encloses the skier's foot, whereas the remaining portion, i.e. the portion which is intended to fit around the leg, is formed as two separate elements from a soft material which are either sewn or cemented to the front and rear quarters or leg sections of the ski boot to protect the skier's tibia and calf.

This prior approach has the disadvantage of involving two successive boot processing steps comprising, in fact, attachment of said front and rear elements to the boot.

According to another conventional approach, a complete inner shoe is provided which is formed laterally with a pair of cuts extending along a perpendicular to the malleoli, thereby can be opened rearwardly to allow the foot thereinto.

This approach, while being simpler constructionwise than the previous one, has the disadvantage that it comprises a shoe portion which requires to be opened after opening the ski boot.

According to a further prior approach, an inner shoe is provided which comprises a lower portion arranged to surround the skier's foot, to which lower portion an upper portion is attached which spans the skier's leg front at the tibia. The skier's calf is protected by means of a rear pad which is associated with the rear quarter or leg section of the boot.

The latter approach, while being advantageous over the previously cited ones, providing an inner shoe wherein the upper portion is pre-attached to the lower portion so that a single element only requires to be attached to the ski boot, has the serious disadvantage of resulting in the boot being made considerably stiffer, thereby its flexibility is accordingly reduced, that is its ability to swing about a substantially horizontal axis perpendicular to the sole longitudinal direction.

SUMMARY OF THE INVENTION

This invention primary object is indeed that of removing the above prior drawbacks by providing a ski boot inner shoe which, while having the upper portion located at the skier's leg front pre-associated with the shoe lower portion, is so constructed as to result in no undesired increase of the ski boot stiffness.

A further object of the invention is that of providing a ski boot inner shoe which affords the possibliity of firmly holding the skier's foot within the ski boot without bringing about any discomfort or annoyance for the skier.

Another object of this invention is to provide such an inner shoe which is comfortable to wear and easily applied.

These and other objects, such as will be apparent hereinafter, are achieved by a ski boot inner shoe, according to the invention, which comprises a lower portion enclosing the skier's foot, and an upper portion connected to said lower portion and spanning the skier's leg front, and is characterized in that it comprises at the connection area between said lower portion and said upper portion at least one flexible section allowing flexure between said upper portion and said lower portion.

BRIEF DESCRIPTION OF THE DRAWING

Further features and advantages will be apparent from the following detailed description of a ski boot inner shoe, as illustrated by way of example and not of limitation in the accompanying drawing the one FIGURE whereof shows a schematical side elevation view of the inner shoe according to this invention.

DESCRIPTION OF THE PREFERRED EMBODIMENT

Making reference to the drawing FIGURE, the rear entry ski boot inner shoe of this invention, which is designated generally with the reference numeral 1, comprises a lower portion 2 having any desired shape and substantially enclosing the user's foot.

Connected to said lower portion 2, as by sewing or other comparable techniques, is an upper portion 3, which is located at the front region of the skier's leg.

Provided at the rearward region of the lower portion is a tab 5 which performs the function of holding the heel more securely.

Furthermore, at the rear edges of the lower portion, there are provided soft padded areas 7 which are effective to secure the ankle region of the skier's leg.

In order to avoid increasing the boot stiffness because of inadequately flexible inner shoe, provided at the connection area between the lower portion 1 and upper portion 3 is a flexible section, indicated at 10, which advantageously comprises a strip of a soft material which spans the sides of the connective portion between the lower portion 2 and upper portion 3.

The provision of the soft strip 10 has the important function of breaking the continuity of the rigid flexure cross-section, it acting in practice as bellows permitting the upper portion and lower portion to swing with respect to each other without applying any significant bias force. Said strip is arranged to be an integral part of the shoe itself, it being formed at the cross-section of maximum resistance, both inside and out.

It should be further added to the foregoing that at the front of the inner shoe constructed as described, a reinforcing foil 11 for protecting the tibia may be provided which has a tapering attachment area, indicated at 12, effective to retain the flexing features mentioned hereinabove.

By providing the inner shoe described hereinabove, it is only required that the ski boot be formed with a rear pad for protecting the calf, which would be applied at the rear quarter or boot leg portion.

It will be appreciated from the foregoing that the invention achieves its objects, and in particular that the provision of a flexible area at the connection between the lower and upper portions affords considerably improved functional characteristics for the inner shoe, since no increase in the stiffness of the ski boot-inner shoe assembly is involved.

Another important advantage is that with the arrangement provided by the invention, the skier's foot is firmly held inside the boot, without undue local pressure actions being exerted thereon such as might create discomfort for the skier.

In practicing the invention, the materials used, if compatible with the specific application, and the dimensions and contingent shapes, may be any ones to meet individual requirements.

What is claimed is:

1. A ski boot inner shoe comprising:

a lower portion enclosing skier's foot an upper portion connected to said lower portion and spanning skier's leg front at least one flexible section arranged in a connection area between said lower portion and said upper portion said flexible section allowing flexure between said upper portion and said lower portion.

2. A ski boot inner shoe, as claimed in claim 1, wherein it comprises a tab associated with the rearward area of said lower portion effective to firmly hold the skier's heel.

3. A ski boot inner shoe, as claimed in claim 1, wherein it comprises, located at the rearward edges of said lower portion, a padded area adapted to act as an ankle securing element.

4. A ski boot inner shoe, as claimed in claim 1, wherein said at least one flexible section comprises a strip of a soft material intervening laterally between said lower portion and said upper portion.

5. A ski boot inner shoe, as claimed in claim 1, wherein it comprises a pair of strips of a soft material arranged on either sides of said inner shoe.

6. A ski boot inner shoe, as claimed in claim 1, wherein it comprises a reinforcement foil provided at the front of said upper portion and having a weakened section located at the area spanned by said at least one flexible section.

* * * * *